US010947800B2

(12) United States Patent
Wan et al.

(10) Patent No.: US 10,947,800 B2
(45) Date of Patent: Mar. 16, 2021

(54) PRESSURE-RETAINING CAP SCREWING AND UNSCREWING DEVICE FOR MARINE NATURAL GAS HYDRATE PRESSURE-RETAINING ROCK-CORE BARREL

(71) Applicant: Hunan University of Science and Technology, Hunan (CN)

(72) Inventors: Buyan Wan, Hunan (CN); Xiaojun Huang, Hunan (CN); Yongping Jin, Hunan (CN)

(73) Assignee: Hunan University of Science and Technology, Xiangtan (CN)

( * ) Notice: Subject to any disclaimer, the term of this patent is extended or adjusted under 35 U.S.C. 154(b) by 0 days.

(21) Appl. No.: 16/833,584

(22) Filed: Mar. 28, 2020

(65) Prior Publication Data

US 2020/0248518 A1 Aug. 6, 2020

Related U.S. Application Data

(63) Continuation of application No. PCT/CN2019/084696, filed on Apr. 27, 2019.

(51) Int. Cl.

| | |
|---|---|
| ***E21B 25/18*** | (2006.01) |
| ***E21B 49/02*** | (2006.01) |
| ***E21B 25/04*** | (2006.01) |

(52) U.S. Cl.

CPC ..... *E21B 25/18* (2013.01); *E21B 49/025* (2013.01); *E21B 25/04* (2013.01)

(58) Field of Classification Search

CPC ..... E21B 25/18; E21B 49/025; E21B 25/04; E21B 19/10; E21B 19/163; E21B 33/035; E21B 33/0355; E21B 33/037; E21B 33/038; E21B 33/0385; E21B 33/0387; E21B 34/04; E21B 41/0007; E21B 49/001

See application file for complete search history.

(56) References Cited

U.S. PATENT DOCUMENTS

| | | | | |
|---|---|---|---|---|
| 3,491,842 A * | 1/1970 | Castela | ..... | E21B 7/124 175/6 |
| 3,664,438 A * | 5/1972 | Winget | ..... | B63C 11/52 175/6 |
| 3,741,320 A * | 6/1973 | Hilfing | ..... | E21B 19/002 175/6 |

FOREIGN PATENT DOCUMENTS

| | | |
|---|---|---|
| CN | 1818323 A | 8/2006 |
| CN | 206174904 U | 5/2017 |
| CN | 108049846 A | 5/2018 |

* cited by examiner

*Primary Examiner* — Michael R Willis, III

(57) ABSTRACT

The present disclosure discloses a pressure-retaining cap screwing and unscrewing device for a marine natural gas hydrate pressure-retaining rock-core barrel, wherein it comprises a cap-unscrewing chuck, a support cylinder, a pressure-retaining cap screwing and unscrewing head, a spring, a screwing and unscrewing shaft, and a pressure-retaining cap screwing and unscrewing sleeve, a reducer and a motor; an input shaft of the reducer is connected to the motor, an output shaft of the reducer is the screwing and unscrewing shaft which is a tubular structure with a plurality of guide holes provided on a side wall thereof. The device is simple in structure, compact, light in weight, and convenient to control, and the pressure-retaining cap can be discarded.

5 Claims, 8 Drawing Sheets

PRESSURE-RETAINING CAP SCREWING AND UNSCREWING DEVICE FOR MARINE NATURAL GAS HYDRATE PRESSURE-RETAINING ROCK-CORE BARREL

CROSS-REFERENCE TO RELATED APPLICATIONS

This application is a continuation of International Application No. PCT/CN2019/084696 with a filling date of Apr. 27, 2019, designating the United states, now pending, and further claims to the benefit of priority from Chinese Patent Application No. 201811213398.1, filed on Oct. 18, 2018. The content of the aforementioned application, including any intervening amendments thereto, is incorporated herein by reference in its entirety.

TECHNICAL FIELD

The present disclosure relates to a pressure cap screwing and unscrewing device, in particular to a pressure-retaining cap screwing and unscrewing device for a marine natural gas hydrate pressure-retaining rock-core barrel.

BACKGROUND

Marine natural gas hydrate is a new type of marine energy resource, and its reserves are huge. The use of pressure-retaining wireline seafloor drill for pressure-retaining wireline seafloor drilling of marine natural gas hydrates is a necessary technical step and means to determine the morphology of marine natural gas hydrate ore bodies, to understand the geological conditions of marine natural gas hydrates, and to conduct economic and technical evaluation of marine natural gas hydrate resources. Before launching the pressure-retaining wireline seafloor drill, first the thread between each empty marine natural gas hydrate pressure-retaining rock-core barrel and the supporting pressure-retaining cap is tightened, and then it is placed on a pipe rack for the pressure-retaining wireline seafloor drill. When it is necessary to place a marine natural gas hydrate pressure-retaining rock-core barrel into a drilling tool, first the pressure-retaining cap is unscrewed from the marine natural gas hydrate pressure-retaining rock-core barrel using a pressure-retaining cap screwing and unscrewing device and is temporarily stored in the pressure-retaining cap screwing and unscrewing device. After the completion of sampling of a marine natural gas hydrate pressure-retaining rock-core barrel, the pressure-retaining cap temporarily stored in the pressure-retaining cap screwing and unscrewing device is screwed onto the marine natural gas hydrate pressure-retaining rock-core barrel using the pressure-retaining cap screwing and unscrewing device, so as to realize sealing of the marine natural gas hydrate pressure-retaining rock-core barrel. Since the pressure-retaining wireline seafloor drill is a large-scale marine remote-operation type equipment, in order to facilitate the control of the drill as well as lowering and recycling of the drill, the overall structure of the drill should be designed to be extremely compact, and the overall weight of the drill should be minimized. Therefore, there is an urgent need to develop a pressure-retaining cap screwing and unscrewing device for a marine natural gas hydrate pressure-retaining rock-core barrel which can not only be mounted and fixed in the frame of the pressure-retaining wireline seafloor drill, but also facilitate the mounting and operating of other components. It should be as light as possible and simple and convenient to control. When a failure occurs between the threads of the marine natural gas hydrate pressure-retaining rock-core barrel and the pressure-retaining cap, the pressure-retaining cap temporarily stored in the pressure-retaining cap screwing and unscrewing device can be discarded, and screwing and unscrewing of threads of the next marine natural gas hydrate pressure-retaining rock-core barrel and the pressure-retaining cap is not affected.

SUMMARY

In order to solve the above technical problems, the present disclosure provides a pressure-retaining cap screwing and unscrewing device for a marine natural gas hydrate pressure-retaining rock-core barrel with a compact structure, light weight, easy control, and a function of abandoning the pressure-retaining cover.

The present disclosure relates to a pressure-retaining cap screwing and unscrewing device for a marine natural gas hydrate pressure-retaining rock-core barrel, wherein it comprises a cap-unscrewing chuck, a support cylinder, a pressure-retaining cap screwing and unscrewing head, a spring, a screwing and unscrewing shaft, and a pressure-retaining cap screwing and unscrewing sleeve, a reducer and a motor; an input shaft of the reducer is connected to the motor, an output shaft of the reducer is the screwing and unscrewing shaft which is a tubular structure with a plurality of guide holes provided on a side wall thereof; a bottom of the screwing and unscrewing shaft is fixed with a connecting head; an end of the pressure-retaining cap screwing and unscrewing head facing the screwing and unscrewing shaft is provided with a blind hole, a top of the blind hole is provided with a guide hole, the top of the blind hole is connected to a boss on a side wall of the screwing and unscrewing shaft through a spring, a top surface of the pressure-retaining cap screwing and unscrewing head is provided with a plurality of forks, the pressure-retaining cap screwing and unscrewing head is coaxial with the screwing and unscrewing shaft; the pressure-retaining cap screwing and unscrewing sleeve is mounted on the screwing and unscrewing shaft and is located outside of the pressure-retaining cap screwing and unscrewing head, a guide plate on an outer wall of the pressure-retaining cap screwing and unscrewing head is mounted in a guide groove of the pressure-retaining cap screwing and unscrewing sleeve; the support cylinder is mounted on the reducer and is located outside of the pressure-retaining cap screwing and unscrewing sleeve; and a top of the support cylinder is mounted with the cap-unscrewing chuck.

Further, a bottom of the pressure-retaining cap screwing and unscrewing sleeve is provided with a polygonal hole, a polygonal boss is provided on the screwing and unscrewing shaft where the screwing and unscrewing sleeve is mounted, the pressure-retaining cap screwing and unscrewing sleeve is mounted on the screwing and unscrewing shaft through cooperation of the polygonal hole of the pressure-retaining cap screwing and unscrewing sleeve with the polygonal boss of the screwing and unscrewing shaft.

Further, the cap-unscrewing chuck comprises a chuck case, two slip bases and two chuck oil cylinders, top and bottom plates of the chuck case are respectively provided with guide holes through which the marine natural gas hydrate pressure-retaining rock-core barrel can pass, the two slip bases are oppositely arranged in the chuck case, facing ends of the two slip bases are each provided with a V-shaped groove composed of three planes, and one of planes of the V-shaped groove which located in the bottom of the V-shaped groove is parallel to a side surface of the slip base 106; opposite ends of the two slip bases are respectively connected with piston rods of the two chuck oil cylinders, piston rods of the two chuck oil cylinders are coaxial, and the chuck oil cylinders are mounted on the chuck case.

Further, each of the three planes of the V-shaped groove on the slip base is provided with alloy slip.

Further, the pressure-retaining cap screwing and unscrewing device for a marine natural gas hydrate pressure-retaining rock-core barrel further comprises a base which is provided with two lifting oil cylinders, a piston rod of the lifting oil cylinder is connected to the reducer; the base is further provided with a high-pressure water pump, a water outlet of the high-pressure water pump is connected with a connector fixed at a bottom of the screwing and unscrewing shaft through a water pipe.

Compared with the prior art, the beneficial effects of the present disclosure are:

The structure of the present disclosure is simple, compact and light in weight. The present disclosure clamps the marine natural gas hydrate pressure-retaining rock-core barrel through the cap-unscrewing chuck, and drives screwing and unscrewing shaft by the motor through the reduction box, causing the pressure-retaining cap screwing and unscrewing sleeve and the pressure-retaining cap screwing and unscrewing head to drive the pressure-retaining cap to screw and unscrew the thread, which realizes the fast screwing and unscrewing of the threads between the marine natural gas hydrate pressure-retaining rock-core barrel and the pressure-retaining cap. When the threads fail between the marine natural gas hydrate pressure-retaining rock-core barrel and the pressure-retaining cap, by supplying high-pressure water to the water pipe at the bottom of the screwing and unscrewing shaft, the pressure-retaining cap temporarily stored in the pressure-retaining screwing and unscrewing device can be discarded, thereby not affecting screwing and unscrewing between the next marine natural gas hydrate pressure-retaining rock-core barrel and the pressure-retaining cap. This device can be mounted and fixed on the pressure-retaining wireline seafloor drill as a component thereof, giving more mounting and working space for other components. The present disclosure also facilitates hydraulic control and is easy to manufacture.

Figure 1:
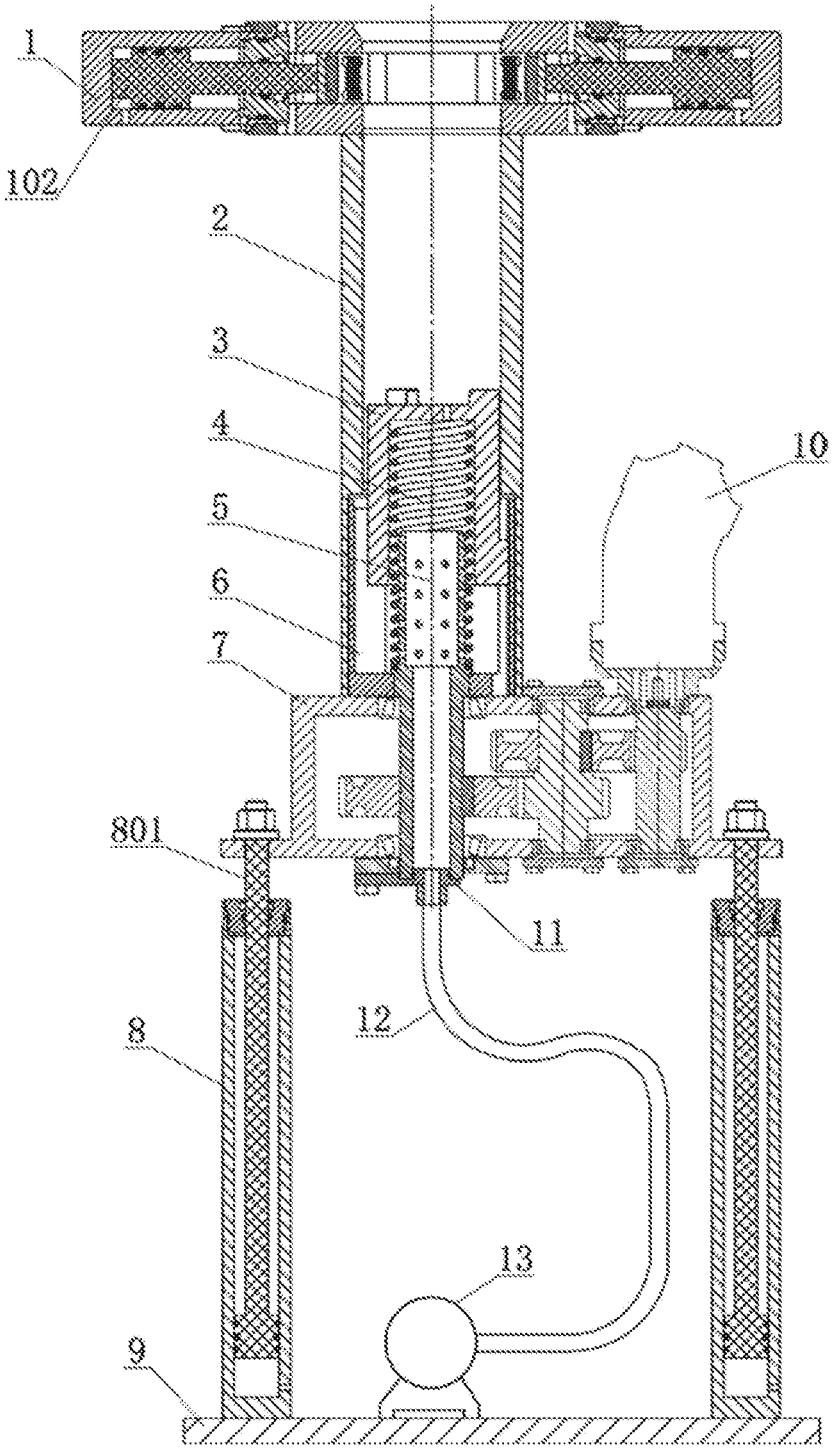
FIG. 1 is a schematic view of the present disclosure.

In the drawings: 1—cap-unscrewing chuck, 101—chuck oil cylinder, 102—piston rod, 103—bolt, 104—chuck case, 105—center guide hole, 106—slip base, 107—alloy slip, 2—support cylinder, 3—pressure-retaining screwing and unscrewing head, 301—guide hole, 302—fork, 303—guide plate, 304—blind hole, 4—spring, 5—screwing and unscrewing shaft, 501—guide hole, 502—boss, 503—octagonal boss, 504—screwing and unscrewing shaft inner hole, 505—screwing and unscrewing shaft key slot, 6—pressure-retaining cap screwing and unscrewing sleeve, 601—guide groove, 602—pressure-retaining cap screw cap Inner hole, 603—octagonal hole, 7—reducer, 8—lift cylinder, 801—lift cylinder piston rod, 9—base, 10—motor, 11—connector, 12—water pipe, 13—high-pressure water pump, 14—marine natural gas hydrate pressure-retaining rock-core barrel, 15—pressure-retaining cap.

DETAILED DESCRIPTION OF EMBODIMENTS

Figure 5:
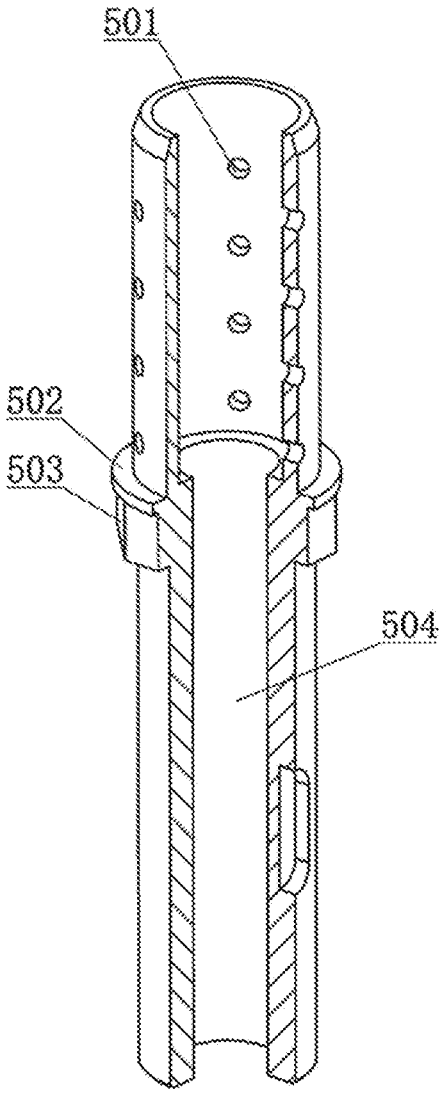
FIG. 5 is a schematic view of a screwing and unscrewing shaft of the present disclosure.

The present disclosure is further described below with reference to the drawings. As shown in FIG. 1, the present disclosure comprises a cap-unscrewing chuck 1, a support cylinder 2, a pressure-retaining screw cap 3, a spring 4, a screwing and unscrewing shaft 5, a pressure-retaining screw cap 6, a reducer 7, a motor 10 and a base 9. The base 9 is provided with two lifting oil cylinders 8 and a high-pressure water pump 13. The lifting oil cylinder piston rod 801 of the lifting oil cylinder 8 is connected to the reducer 1. The input shaft of the reducer 7 is connected to the motor 10. The output shaft of the reducer 7 is the screwing and unscrewing shaft 5. The screwing and unscrewing shaft 5 is a tubular structure of which the side wall is provided with a plurality of guide holes 501 (as shown in FIG. 5). A connecting head 11 is fixed at the bottom of the screwing and unscrewing shaft 5, and the connecting head 11 is connected to the water outlet of the high-pressure water pump 13 through a water pipe 12.

Figure 4:
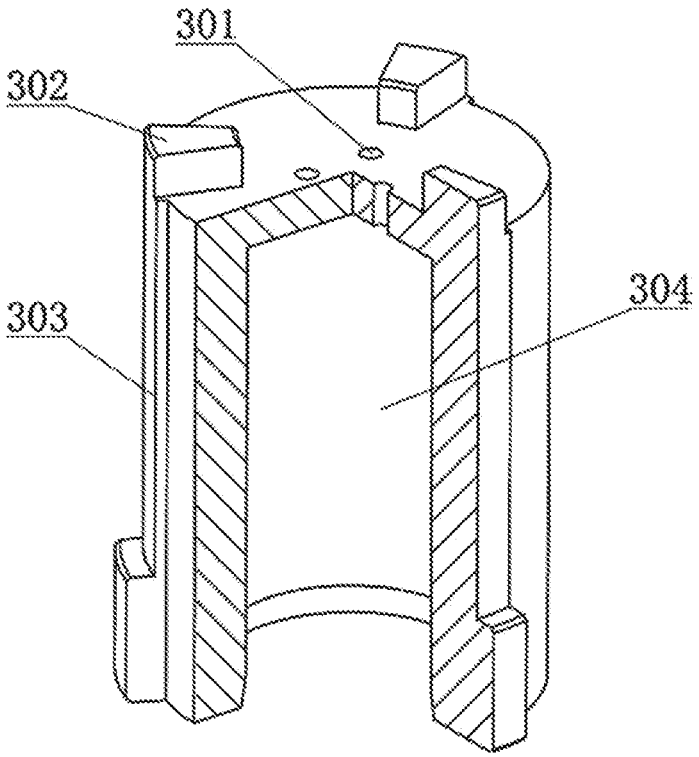
FIG. 4 is a schematic view of a pressure-retaining cap screwing and unscrewing head of the present disclosure.
Figure 6:
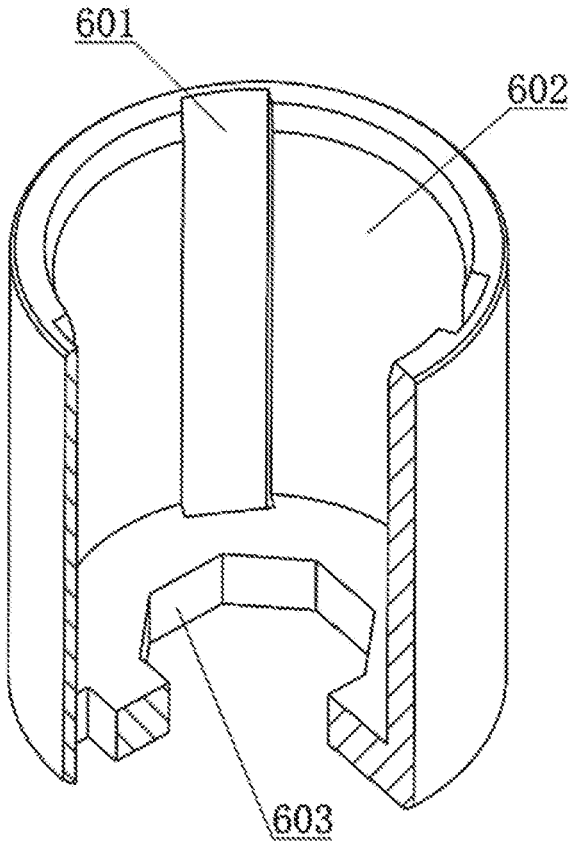
FIG. 6 is a schematic view of a pressure-retaining screwing and unscrewing sleeve of the present disclosure.
Figure 7:
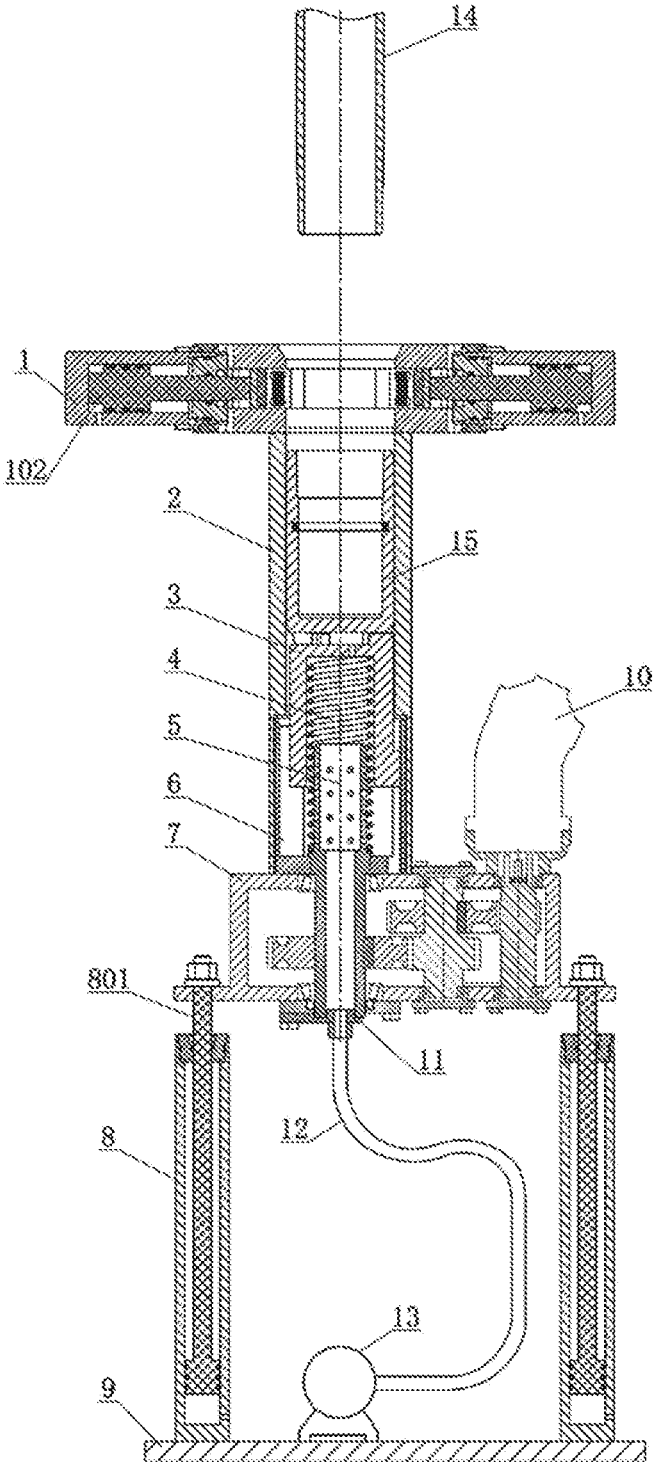
FIG. 7 is a state diagram of the marine natural gas hydrate pressure-retaining rock-core barrel and the pressure-retaining cap before screwing (the pressure-retaining cap has been temporarily stored in the pressure-retaining screwing and unscrewing device).
Figure 8:
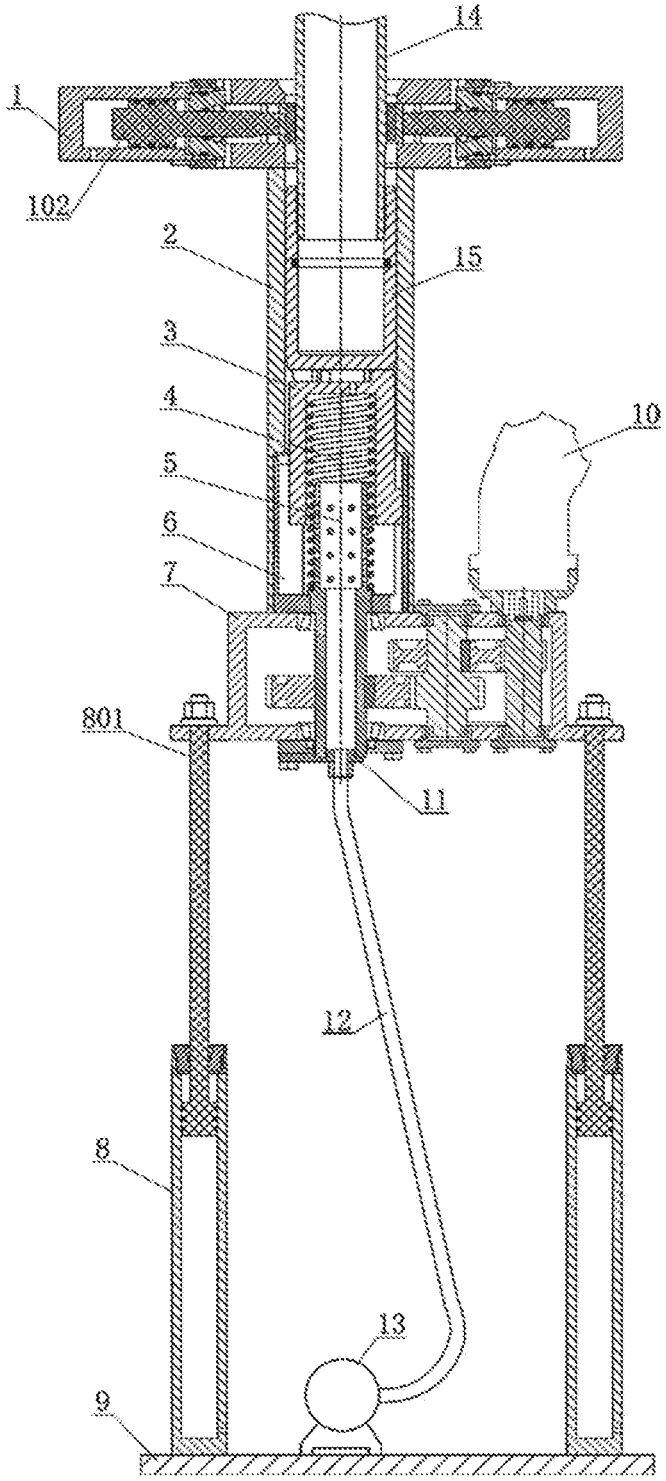
FIG. 8 is a state diagram of the marine natural gas hydrate pressure-retaining rock-core barrel and the pressure-retaining cap upon screwing.
Figure 9:
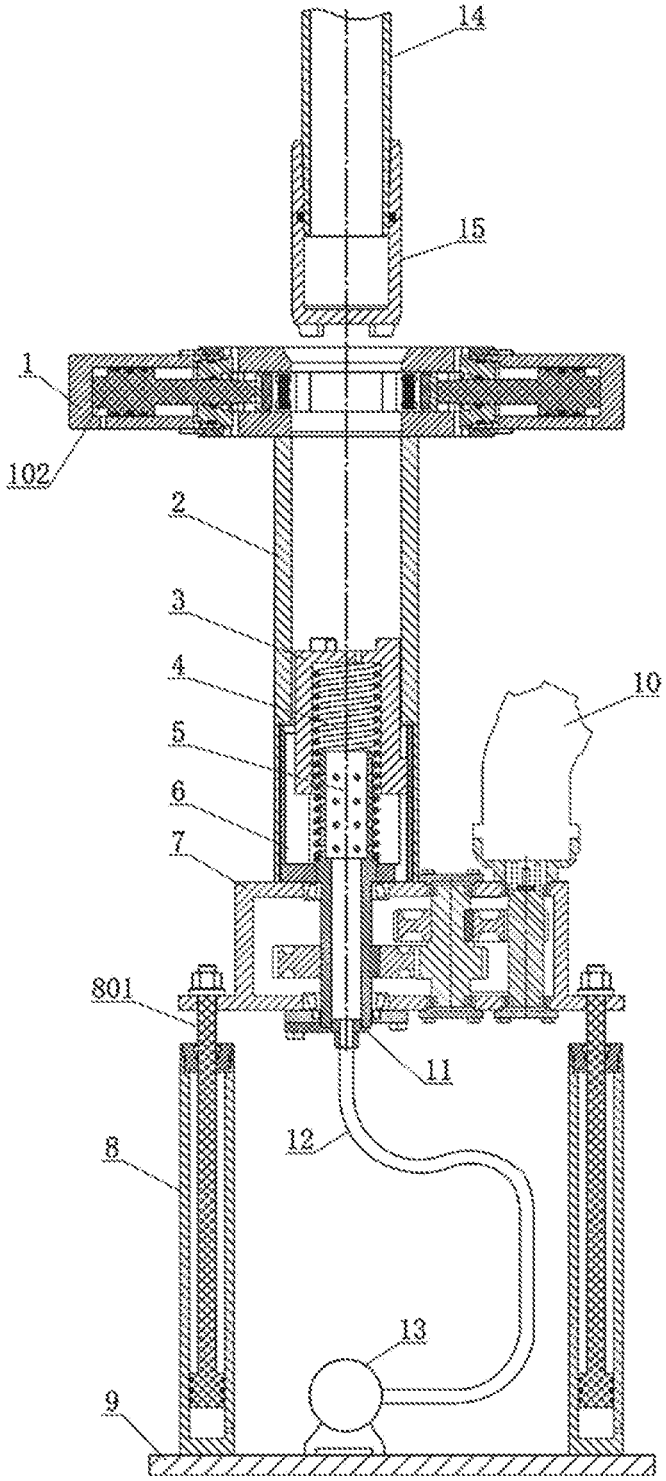
FIG. 9 is a state diagram of the marine natural gas hydrate pressure-retaining rock-core barrel and the pressure-retaining cap after screwing.

As shown in FIGS. 1, 4 and 5, the end of the pressure-retaining cap screwing and unscrewing head 3 facing the screwing and unscrewing shaft is provided with a blind hole 304 which is provided with a guide hole 301 at the top. The top of the blind hole 304 is connected to the circular boss 502 on the side wall of the screwing and unscrewing shaft 5 through a spring; the blind hole 304 can accommodate the pressure-retaining screwing and unscrewing head 3 of the spring 4; the top surface of the pressure-retaining screwing and unscrewing head 3 is provided with a plurality of forks 302; and the pressure-retaining cap screwing and unscrewing head 3 and the screwing and unscrewing shaft 5 are coaxial. As shown in FIGS. 1, 5 and 6, the bottom of the pressure-retaining cap screwing and unscrewing sleeve 6 is provided with an octagonal hole 603 (it can also be a quadrangular hole, a pentagonal hole, or other polygonal hole). An octagonal boss 503 (also a polygonal boss such as a quadrangular boss, a pentagonal boss, etc.) is provided on the screwing and unscrewing shaft 5 at where the pressure-retaining cap screwing and unscrewing sleeve is mounted; the pressure-retaining cap screwing and unscrewing sleeve 6 is engaged on the octagonal boss 503 of the screwing and unscrewing shaft through the octagonal hole 603, located outside the retaining cap screwing and unscrewing head 3; the outer wall of the retaining cap screwing and unscrewing head 3 is evenly arranged with four guide plates 303, and the inner wall of the retaining cap screwing and unscrewing sleeve 6 is evenly arranged with four guide grooves 601; and the four guide plates 303 of the pressure-retaining cap screwing and unscrewing head 3 are respectively mounted in the four guide grooves 601 of the pressure-retaining cap screwing and unscrewing sleeve. The support cylinder 2 is mounted on the reducer, and is located outside the pressure-retaining cap screwing and unscrewing sleeve 6; and the top of the support cylinder 2 is equipped with a cap-unscrewing chuck 1.

Figure 2:
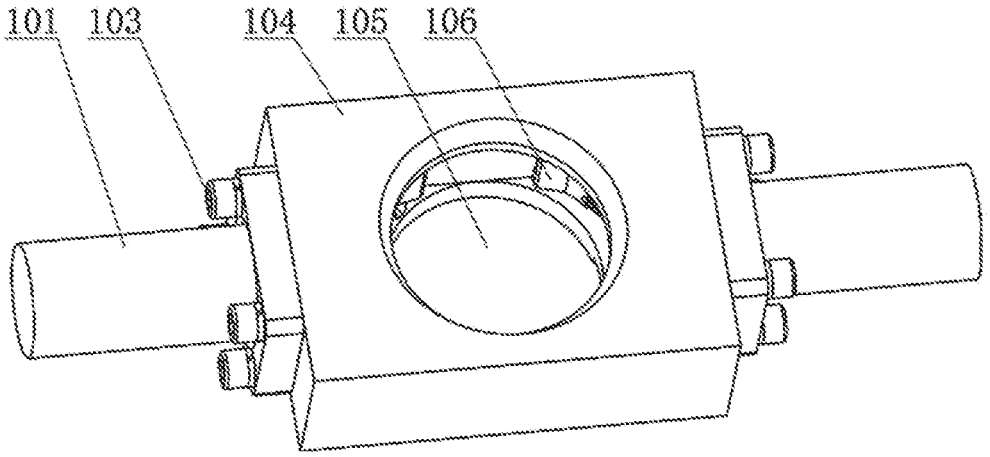
FIG. 2 is a schematic view of a cap-unscrewing chuck according to the present disclosure.
Figure 3:
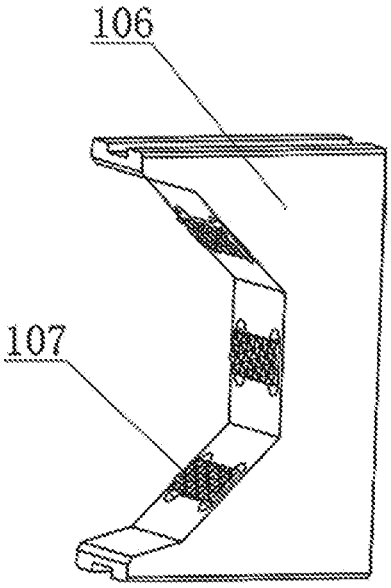
FIG. 3 is a schematic view of a slip base of a cap-unscrewing chuck according to the present disclosure.

As shown in FIGS. 1, 2, and 3, the cap-unscrewing chuck 1 comprises a chuck case 104, two slip bases 106, and two chuck oil cylinders 101. The top and bottom plates of the chuck case 104 are respectively provided with guide holes 105 through which the marine natural gas hydrate pressure-retaining rock-core barrels can pass. Facing ends of the two slip bases 106 are each provided with a V-shaped groove composed of three planes, and one of planes of the V-shaped groove which located in the bottom of the V-shaped groove is parallel to a side surface of the slip base 106, and the three planes composing the V-shaped groove are respectively provided with alloy slip 107. Opposite ends of the two slip bases 106 are respectively connected with piston rods 102 of the two chuck oil cylinders 101, piston rods 102 of the two chuck oil cylinders 101 are coaxial, and the chuck oil cylinders 101 are mounted on the chuck case 104.

When the present disclosure is used, it clamps the marine natural gas hydrate pressure-retaining rock-core barrel 14 through the cap-unscrewing chuck 1, and drives screwing and unscrewing shaft 7 by the motor 10 through the reduction box 7, causing the pressure-retaining cap screwing and unscrewing sleeve 6 and the pressure-retaining cap screwing and unscrewing head 3 to drive the pressure-retaining cap 15 to screw and unscrew the thread, which realizes the fast screwing and unscrewing of the threads between the marine natural gas hydrate pressure-retaining rock-core barrel and the pressure-retaining cap. When the threads fail between the marine natural gas hydrate pressure-retaining rock-core barrel 14 and the pressure-retaining cap 15, by supplying high-pressure water to the screwing and unscrewing shaft 15 through the water pipe 12 by the high pressure pump 13, the pressure-retaining cap 15 temporarily stored in the pressure-retaining screwing and unscrewing device can be discarded, thereby not affecting screwing and unscrewing of threads of the next marine natural gas hydrate pressure-retaining rock-core barrel and the pressure-retaining cap.

What is claimed is:

1. A pressure-retaining cap screwing and unscrewing device for a marine natural gas hydrate pressure-retaining rock-core barrel, wherein the pressure-retaining cap screwing and unscrewing device comprises a cap-unscrewing chuck, a support cylinder, a pressure-retaining cap screwing and unscrewing head, a spring, a screwing and unscrewing shaft, and a pressure-retaining cap screwing and unscrewing sleeve, a reducer and a motor; an input shaft of the reducer is connected to the motor, an output shaft of the reducer is the screwing and unscrewing shaft which is a tubular structure with a plurality of guide holes provided on a side wall thereof; a bottom of the screwing and unscrewing shaft is fixed with a connecting head; an end of the pressure-retaining cap screwing and unscrewing head facing the screwing and unscrewing shaft is provided with a blind hole, a top of the blind hole is provided with a guide hole, the top of the blind hole is connected to a boss on a side wall of the screwing and unscrewing shaft through a spring, a top surface of the pressure-retaining cap screwing and unscrewing head is provided with a plurality of forks, the pressure-retaining cap screwing and unscrewing head is coaxial with the screwing and unscrewing shaft; the pressure-retaining cap screwing and unscrewing sleeve is mounted on the screwing and unscrewing shaft and is located outside of the pressure-retaining cap screwing and unscrewing head, a guide plate on an outer wall of the pressure-retaining cap screwing and unscrewing head is mounted in a guide groove of the pressure-retaining cap screwing and unscrewing sleeve; the support cylinder is mounted on the reducer and is located outside of the pressure-retaining cap screwing and unscrewing sleeve; and a top of the support cylinder is mounted with the cap-unscrewing chuck.

2. The pressure-retaining cap screwing and unscrewing device for the marine natural gas hydrate pressure-retaining rock-core barrel according to claim 1, wherein a bottom of the pressure-retaining cap screwing and unscrewing sleeve is provided with a polygonal hole, a polygonal boss is provided on the screwing and unscrewing shaft where the screwing and unscrewing sleeve is mounted, the pressure-retaining cap screwing and unscrewing sleeve is mounted on the screwing and unscrewing shaft through cooperation of the polygonal hole of the pressure-retaining cap screwing and unscrewing sleeve with the polygonal boss of the screwing and unscrewing shaft.

3. The pressure-retaining cap screwing and unscrewing device for the marine natural gas hydrate pressure-retaining rock-core barrel according to claim 1, wherein the cap-unscrewing chuck comprises a chuck case, two slip bases and two chuck oil cylinders, top and bottom plates of the chuck case are respectively provided with guide holes through which the marine natural gas hydrate pressure-retaining rock-core barrel can pass, the two slip bases are oppositely arranged in the chuck case, facing ends of the two slip bases are each provided with a V-shaped groove composed of three planes, and one of planes of the V-shaped groove which located in the bottom of the V-shaped groove is parallel to a side surface of the slip base 106; opposite ends of the two slip bases are respectively connected with piston rods of the two chuck oil cylinders, piston rods of the two chuck oil cylinders are coaxial, and the chuck oil cylinders are mounted on the chuck case.

4. The pressure-retaining cap screwing and unscrewing device for the marine natural gas hydrate pressure-retaining rock-core barrel according to claim 3, wherein each of the three planes of the V-shaped groove on the slip base is provided with alloy slip.

5. The pressure-retaining cap screwing and unscrewing device for the marine natural gas hydrate pressure-retaining rock-core barrel according to claim 1, further comprising a base which is provided with two lifting oil cylinders, a piston rod of the lifting oil cylinder is connected to the reducer; the base is further provided with a high-pressure water pump, a water outlet of the high-pressure water pump is connected with a connector fixed at a bottom of the screwing and unscrewing shaft through a water pipe.

* * * * *